US011746521B2

(12) United States Patent
Shiohara et al.

(10) Patent No.: US 11,746,521 B2
(45) Date of Patent: Sep. 5, 2023

(54) REINFORCED STRUCTURE FOR COLUMN AND BEAM FRAME

(71) Applicants: THE UNIVERSITY OF TOKYO, Tokyo (JP); Masaomi Teshigawara, Tokyo (JP); Yoshio Inoue, Tokyo (JP); SANKO TECHONO CO., LTD., Chiba (JP); KSE network Co., Ltd., Tokyo (JP); OHMOTO GUMI Co., Ltd., Okayama (JP); ssd Corporation, Chiba (JP)

(72) Inventors: Hitoshi Shiohara, Tokyo (JP); Masaomi Teshigawara, Tokyo (JP); Yoshio Inoue, Tokyo (JP); Takashi Sato, Chiba (JP); Yasue Yagisawa, Chiba (JP); Kenji Yokota, Tokyo (JP); Syunichiro Shishido, Chiba (JP); Koji Oka, Okayama (JP)

(73) Assignees: THE UNIVERSITY OF TOKYO, Tokyo (JP); SANKO TECHNO CO., LTD., Nagareyama (JP); KSE NETWORK CO., LTD., Tokyo (JP); SSD CORPORATION, Ichikawa (JP); OHMOTO GUMI CO., LTD., Okayama (JP); Yoshio Inoue, Tokyo (JP); Masaomi Teshigawara, Tokyo (JP)

( * ) Notice: Subject to any disclaimer, the term of this patent is extended or adjusted under 35 U.S.C. 154(b) by 0 days.

(21) Appl. No.: 17/774,956

(22) PCT Filed: Aug. 4, 2021

(86) PCT No.: PCT/JP2021/028933
§ 371 (c)(1),
(2) Date: May 6, 2022

(87) PCT Pub. No.: WO2022/070601
PCT Pub. Date: Apr. 7, 2022

(65) Prior Publication Data
US 2022/0403642 A1 Dec. 22, 2022

(30) Foreign Application Priority Data
Sep. 29, 2020 (JP) ..... 2020-163493

(51) Int. Cl.
*E04B 1/20* (2006.01)
*E04B 2/56* (2006.01)

(52) U.S. Cl.
CPC . *E04B 1/20* (2013.01); *E04B 2/56* (2013.01)

(58) Field of Classification Search
CPC ..... E04B 1/20; E04B 2/56; E04G 23/02
(Continued)

(56) References Cited

U.S. PATENT DOCUMENTS 2,022,950 A * 12/1935 Buzzoni ..... E04B 1/20 52/319
3,251,169 A * 5/1966 Cornelissen ..... E04B 2/56 52/287.1

(Continued)

FOREIGN PATENT DOCUMENTS

JP 11-050690 2/1999
JP 2000-226938 A 8/2000

(Continued)

OTHER PUBLICATIONS

International Search Report (Form PCT/ISA/210); dated Nov. 2, 2021 in corresponding PCT Application No. PCT/JP2021/028933 (3 pages) (2 pages English Translation).

(Continued)

*Primary Examiner* — Brian D Mattei
*Assistant Examiner* — Joseph J. Sadlon
(74) *Attorney, Agent, or Firm* — STAAS & HALSEY LLP

(57) ABSTRACT

A fracture caused by fatigue of a connecting portion positioned at a corner of a reinforcing frame directly secured to (Continued)

a frame is avoided regardless of a relative displacement that occurs in the frame upon disposing the reinforcing frame made of steel, which has an elevational shape surrounding the frame along an inner circumferential surface of the frame and a cross-sectional shape with a flange on a side of the frame, in a structure plane of the frame of a column and a beam of reinforced concrete structure, and joining the reinforcing frame to the inner circumferential surface of the frame. A reinforcing frame is constituted of a column portion along a column of a frame, a beam portion along a beam, and a connecting portion that is joined to the column portion and the beam portion, and connects the column portion to the beam portion. The connecting portion has a flange with a part close to the column portion and the beam portion formed to be shaped along an inner circumferential surface of the frame, and a part of the flange facing a corner of the frame formed into a shape in which a void is formed between the part and the corner of the frame.

8 Claims, 6 Drawing Sheets

(58) Field of Classification Search
USPC ..... 52/344
See application file for complete search history.

(56) References Cited

U.S. PATENT DOCUMENTS 3,429,092 A * 2/1969 Hart ..... E04B 1/4157 52/236.7
3,594,971 A * 7/1971 Hughes ..... E04B 1/215 52/432
3,780,480 A * 12/1973 Cvijanovic ..... E04B 1/215 52/587.1
3,818,671 A * 6/1974 Matsushita ..... E04G 1/14 52/651.07
3,846,946 A * 11/1974 Sandstrom ..... E04B 5/48 52/220.3
3,996,714 A * 12/1976 Hazelett, Jr. ..... E04C 2/06 52/367
4,060,948 A * 12/1977 Brownlee ..... E04B 1/21 249/19
4,272,050 A * 6/1981 del Valle ..... B28B 15/00 249/168
4,330,970 A * 5/1982 Bonink ..... E04B 1/215 52/236.7
4,472,331 A * 9/1984 Kida ..... E04C 5/16 264/35
4,786,026 A * 11/1988 Bailey ..... E04B 2/56 404/74
5,123,220 A * 6/1992 Simenoff ..... E04B 1/215 52/236.8
5,259,160 A * 11/1993 Carannante ..... E04B 1/2403 52/260
5,349,794 A * 9/1994 Taga ..... E04C 5/01 52/167.1
5,479,748 A * 1/1996 Siller ..... E04G 23/0218 52/231
5,678,374 A * 10/1997 Fukuoka ..... E04G 23/0218 14/74
5,827,006 A * 10/1998 Hoshino ..... E04B 1/215 403/339
6,012,256 A * 1/2000 Aschheim ..... E04C 3/086 52/573.1
6,779,314 B1 * 8/2004 Fan ..... E04B 1/24 52/309.7
6,920,724 B1 * 7/2005 Hundley ..... E04B 1/24 52/656.1
6,941,718 B1 * 9/2005 diGirolamo ..... E04C 2/384 52/696
7,188,452 B2 * 3/2007 Sridhara ..... E04H 9/0237 188/266
7,296,385 B2 * 11/2007 Andra ..... E04C 5/127 52/223.13
7,299,596 B2 * 11/2007 Hildreth ..... E04B 1/24 52/656.1
7,647,733 B2 * 1/2010 Nakamura ..... E04H 9/0237 52/167.3
7,703,244 B2 * 4/2010 Suzuki ..... E04B 1/24 403/217
8,028,493 B2 * 10/2011 Holmes ..... E04C 3/293 52/745.05
8,561,371 B2 * 10/2013 Sanders ..... E04B 1/14 52/764
8,919,058 B2 * 12/2014 Liberman ..... E04B 1/34384 52/79.9
8,925,278 B2 * 1/2015 Sugihara ..... E04B 2/56 52/657
9,068,365 B2 * 6/2015 Berset ..... E04G 23/0218
10,738,463 B2 * 8/2020 Miller ..... E04B 1/585
10,745,914 B1 * 8/2020 Fox ..... E04C 3/04
11,142,900 B2 * 10/2021 Ishaq ..... E04B 1/08
2004/0134152 A1 * 7/2004 Powell ..... E04B 1/20 52/561
2018/0320363 A1 * 11/2018 Hong ..... E04C 5/0645

FOREIGN PATENT DOCUMENTS

JP 2002285708 A 10/2002
JP 2007132108 A * 5/2007
JP 2014-509356 A 4/2014
JP 2016-000894 A 1/2016
JP 2016000894 A * 1/2016
JP 2018-076677 A 5/2018
JP 2018-199923 A 12/2018
JP 2019-157430 A 9/2019
KR 10-2012-0091612 A 8/2012
WO WO 2012/108703 A2 8/2012

OTHER PUBLICATIONS

Written Opinion (Form PCT/ISA/237); dated Nov. 2, 2021 in corresponding PCT Application No. PCT/JP2021/028933 (4 pages English Translation).

* cited by examiner

REINFORCED STRUCTURE FOR COLUMN AND BEAM FRAME

CROSS-REFERENCE TO RELATED APPLICATIONS

This is a national stage application under 35 USC 371 of PCT Application No. PCT/JP2021/028933, filed Aug. 4, 2021, which claims priority from Japanese Patent Application No. 2020-163493, filed on Sep. 29, 2020, both of which are incorporated herein by reference in their entirety.

TECHNICAL FIELD

The present invention relates to a reinforced structure for a column and beam frame in which a reinforcing frame made of steel, which has an elevational shape surrounding a frame along an inner circumferential surface of the frame and a cross-sectional shape with a flange on a frame side, is disposed in a structure plane of the frame of a column and a beam of reinforced concrete structure and is joined to the inner circumferential surface of the frame.

BACKGROUND ART

When it is attempted to reinforce a frame by disposing a reinforcing frame made of steel having an elevational shape surrounding the frame along an inner circumferential surface of the frame in a structure plane of the frame of a column and a beam of reinforced concrete structure, a method is often employed that ensures a space for buffering between the inner circumferential surface of the frame and an outer circumferential surface of the reinforcing frame, and fills a filler, such as mortar, in this space (see Patent Documents 1 to 3).

There may be a difference in in-plane rigidity between the frame and the reinforcing frame, and thus, it is possible that the reinforcing frame fails to flexibly follow a deformation of the frame. Therefore, it is considered to ensure a filler layer for buffering between the frame and the reinforcing frame. A steel material of, for example, shaped steel is joined to the inner circumferential surface of the frame using an anchor (an anchor bolt), and the filler is filled in the space between the steel material and the reinforcing frame. In the filler, for example, a spiral reinforcement for ensuring integrity between the steel material and the reinforcing frame is arranged (see Patent Documents 1 to 3).

However, it is possible that a frame reinforcement effect by the reinforcing frame is not sufficiently provided as long as the reinforcing frame is not directly joined to the inner circumferential surface of the frame, and besides, a case is anticipated where the filler brittly breaks when the frame deforms in a structure plane direction. In the case where the filler breaks, a shear force transmission mechanism in the structure plane direction between the frame and the reinforcing frame is lost.

In contrast to this, there is a method that inscribes a baseplate integrated with a reinforcing frame in a frame, and directly joins the baseplate to an inner circumferential surface of the frame using an anchor (see Patent Document 4).

Patent Document 1: JP-A-2000-226938 (paragraphs 0010 to 0013, FIG. 1 to FIG. 4)

Patent Document 2: JP-A-2002-285708 (paragraphs 0018 to 0026, FIG. 1 to FIG. 3)

Patent Document 3: JP-A-2018-76677 (paragraphs 0019 to 0038, FIG. 1 to FIG. 3)

Patent Document 4: JP-A-11-50690 (paragraphs 0011 to 0013, FIG. 1 and FIG. 2)

DISCLOSURE OF THE INVENTION

Problems to be Solved by the Invention

In the method in Patent Document 4, the baseplate having plate elements in two directions along an inner circumferential surface of a column and an inner circumferential surface of a beam of the frame is directly inscribed in the frame. In view of this, when a relative displacement in the structure plane direction occurs in the frame, the plate elements in the two directions attempt to maintain a state of being respectively integrated with the beam and the column constituting the frame. For this reason, the plate elements in the two directions have an intersecting portion in which a forcible bending deformation of an amount of an interlayer deformation angle occurring at a corner of the frame is repeated, thereby causing fatigue of the intersecting portion of the plate elements to possibly lead to a fracture.

Specifically speaking, flanges as the plate elements in the two directions are continuously integrated with webs forming surfaces perpendicular to the flanges, and in relation to this, the flanges in the two directions are in a state of being restrained by the webs when following the deformation of the frame, and the webs are in a state of being restrained by the flanges. That is, both the flanges and the webs have a lowered degree of freedom in deforming, and therefore, when the deformation of the frame is repeated, the flanges and the webs fall into a state of being subjected to the forcible deformation and are likely to be subjected to a concentration of stress. As the result, the flanges and the webs have fatigue to be easily fractured.

From the above-described background, the present invention is to propose a reinforced structure for a column and beam frame that may avoid a fracture caused by fatigue of a connecting portion positioned at a corner of a reinforcing frame directly secured to a frame, regardless of a relative displacement that occurs in the frame.

Solutions to the Problems

It is a configuration requirement for a reinforced structure for a column and beam frame according to claim 1 that the reinforced structure for the column and beam frame includes a reinforcing frame made of steel disposed in a structure plane of a frame of a column and a beam of reinforced concrete structure, the reinforcing frame being joined to an inner circumferential surface of the frame, the reinforcing frame having an elevational shape surrounding the frame along the inner circumferential surface of the frame, the reinforcing frame having a cross-sectional shape with a flange on a side of the frame, wherein the reinforcing frame includes:

a column portion along the column;

a beam portion along the beam; and a connecting portion joined to the column portion and the beam portion, the connecting portion connecting the column portion to the beam portion, and the connecting portion has a flange having a part close to the column portion and the beam portion shaped along the inner circumferential surface of the frame and has a part of the flange facing a corner of the frame in a shape in which a void is formed between the part and the corner of the frame.

Since the reinforcing frame has the elevational shape surrounding the frame of the column and the beam along the inner circumferential surface of the frame, it is basically formed into a square shape excluding the corner. Since the connecting portion having the void between the connecting portion and the inner circumferential surface of the frame is disposed at the corner of the reinforcing frame, the reinforcing frame does not form a square shape when the corner is included, and the corner (the connecting portion) of the reinforcing frame is basically formed into a convex arc shape or a multangular shape toward the frame side.

Since the reinforcing frame has the flange on the frame side, the reinforcing frame has a cross-sectional shape, such as a T-shaped cross-sectional surface or an H-shaped cross-sectional surface, when the reinforcing frame is viewed in a cross section in an axial direction, and the reinforcing frame is joined (secured) to the frame by fixing an anchor passing through the flange in concrete of the frame. The anchor includes an anchor bolt. Since the reinforcing frame has a cross-sectional shape having the flange on the frame side, the reinforcing frame has at least the flange and the web that forms a surface perpendicular to the flange. The column portion and the beam portion constituting the reinforcing frame both continue in a circumferential direction by being joined to the connecting portion disposed at the corner by, for example, welding. The reinforced concrete structure of the column and beam frame includes steel-reinforced concrete structure.

Since the reinforcing frame is joined in a state of being in direct contact with the frame in the flange on the frame side or in a state with any clearance adjustment material (a buffer) interposed, no filler layer having a thickness in which a spiral reinforcement is disposed is formed between the reinforcing frame and the frame as in Patent Documents 1 to 3. Accordingly, there occurs no case of a lost shear force transmission mechanism in the structure plane direction caused by brittle breaking of the filler, for example, when the filler layer is interposed between the reinforcing frame and the frame.

The term "the part of the flange of the connecting portion constituting the reinforcing frame close to the corner of the frame has the shape in which the void is formed between the part and the corner of the frame" in claim 1 refers to a part of a flange 71 of a connecting portion 7 close to a corner 1C of a frame 1 being in a state of floating from the corner 1C of the frame 1 and in a state of not being in contact with the corner 1C of the frame 1 as illustrated in FIG. 1.

A reinforcing frame 4 can be in a state of being joined to the frame 1 when the reinforcing frame 4 is joined to a column 2 and a beam 3 of the frame 1 at a column portion 5 and a beam portion 6, and thus, the connecting portion 7 is not joined to the frame 1 in some cases. However, the connecting portion 7 may have the flange 71 and a web 72 and may be joined (secured) to the column 2 and the beam 3 of the frame 1 in the flange 71 (claim 3). In this case, the flange 71 of the connecting portion 7 is joined to the frame 1, and thus, integrity with the frame 1 in the connecting portion 7 is ensured and a separation between the reinforcing frame 4 and the frame 1 when an in-plane deformation occurs in the frame 1 is less likely to occur. Therefore, a reinforcement effect of the frame 1 in the connecting portion 7 is expected.

The part of the flange 71 of the connecting portion 7 is in the state of floating from the corner 1C of the frame 1, and thus, when the frame 1 deforms in the structure plane direction, the flange 71 does not have to be subjected to a forcible deformation from the frame 1. In view of this, a following capability of the part of the flange 71 to an interlayer deformation angle is improved to reduce a chance that the flange 71 is subjected to the forcible deformation. As the result, a chance that the web 72 is subjected to a forcible deformation from the flange 71 is also reduced, and thus, the fatigue caused by the forcible deformation of the flange 71 and the web 72, and the fracture caused by the fatigue are easily avoided.

The term "the part of the flange of the connecting portion is in the state of floating from the frame" specifically refers, for example, to a part of the flange 71 of the connecting portion 7 facing the corner 1C of the frame 1 being curved (claim 2). Since the word "curve" is a curve in the state of floating from the corner 1C of the frame 1, when it is viewed from a main body of the connecting portion 7 excluding the flange 71, it refers to at least a part of the flange 71 forming a convex curved surface in a side of the corner 1C of the frame 1. The flange 71 of the connecting portion 7 may be formed into a multangular shape generally close to a curve. The part of the flange 71 of the connecting portion 7 floating from the corner 1C of the frame 1 (the part of the flange 71) indicates a part excluding a part in contact with the column 2 and a part in contact with the beam 3 of the frame 1 or a part excluding a part secured to the column 2 and the beam 3 with an anchor 8.

When the part of the flange 71 of the connecting portion 7 is curved (claim 2), the curved surface continues when the flange 71 follows the deformation in the in-plane direction of the frame 1, and thus, a local concentration of stress is less likely to be generated in an out-of-plane direction of the flange 71 and the stress is easily dispersed in comparison to when a flange is square as in Patent Document 4. Therefore, there is an advantage in that the fracture caused by the fatigue is less likely to occur.

When the frame 1 deforms in the in-plane direction, the anchors 8 that join the flanges 51, 61, and 71 of the reinforcing frame 4 to the frame 1 is subjected to an action of shear force in a direction perpendicular to the axial direction. In the case of the anchor bolts, post-installed anchors, or the like, head portions 82 of the anchors 8 are in states of projecting to sides of the webs 52, 62, and 72 with respect to the flanges 51, 61, and 71. On the other hand, when the flanges 51, 61, and 71 of the reinforcing frame 4 are joined in states of being in contact with the inner circumferential surface of the frame 1 as in Patent Document 4, the flanges 51, 61, and 71 of the reinforcing frame 4 can have a relative movement (slippage) in the axial direction of the column 2 and the beam 3 between the flanges 51, 61, and 71 and the frame 1 when the frame 1 deforms. Therefore, the head portions 82 of the anchors 8 have a potential fracture by being subjected to repeated shear force.

For such a case, it is possible to improve safety for the fracture of the head portion 82 of the anchor 8 by forming a part (an inserted portion 83) lockable to an inner circumferential surface of a bore hole 1*a* in the head portion 82 of the anchor 8 that passes through the flanges 51, 61, and 71, is buried in concrete of the frame 1, and is fixed to each of the flanges 51, 61, and 71 of the column portion 5 and the beam portion 6, and the connecting portion 7 of the reinforcing frame 4 (claim 4). In this case, the anchor 8 has a shaft portion 81 inserted into the bore hole 1*a* formed in the concrete of the frame 1 and the head portion 82 connected to the shaft portion 81, and has the inserted portion 83 inserted into the bore hole 1*a* and in a shape continuing in a circumferential direction of the head portion 82 is formed in the head portion 82 on a side of the frame 1 (claim 4). The shape of the inserted portion 83 includes a tubular shape (a hollow shape), a ring shape, a column shape (a solid shape), and the like.

In this case, the inserted portion 83 is in a state of being engaged in a radiation direction (a direction perpendicular to an axis) of the shaft portion 81 to a curable filler 9, such as the concrete of the frame 1 positioned around the shaft portion 81 or mortar filled into the bore hole 1*a*. As the result, the shear force in the direction perpendicular to the axis of the shaft portion 81 from the flanges 51, 61, and 71 of the reinforcing frame 4 received by the head portion 82 or the shaft portion 81 of the anchor 8 can be transmitted to the concrete (the frame 1) while being dispersed in the axial direction through the head portion 82 and the shaft portion 81, thereby improving transmission efficiency of the shear force.

In particular, the inserted portion 83 is in a shape continuing in the circumferential direction of the head portion 82 and is locked to the concrete or the like in a state of directly getting into (being inserted into) an inside of the frame 1 (in the concrete or the like), and thus, an outer circumferential surface of the inserted portion 83 directly transmits the shear force in a direction perpendicular to the shaft portion 81 to the concrete in a side of the outer circumference of the inserted portion 83. Additionally, it is in a state where an inner circumferential surface of the inserted portion 83 directly transmits the shear force in the direction perpendicular to the shaft portion 81 to the concrete and the filler 9 in an inner circumference side of the inserted portion 83, thereby ensuring the transmission from both the outer circumferential surface and the inner circumferential surface of the inserted portion 83.

When the frame 1 exists, the inserted portion 83 has a case in which the inserted portion 83 is positioned in the bore hole 1*a* (the filler 9) formed in the concrete as illustrated in FIG. 1 and FIG. 2A and a case in which the inserted portion 83 is positioned at an outer circumference side of the bore hole 1*a* (the filler 9). When the inserted portion 83 is positioned in the bore hole 1*a*, the outer circumferential surface of the inserted portion 83 has a case in which the outer circumferential surface of the inserted portion 83 is in contact with the concrete of the frame 1 and a case in which the outer circumferential surface of the inserted portion 83 is in contact with the filler 9. When the inserted portion 83 is positioned outside the bore hole 1*a*, the outer circumferential surface of the inserted portion 83 is in contact with the concrete of the frame 1 and the inner circumferential surface is in contact with the concrete or the filler 9.

The term "the filler 9 filled around the shaft portion 81" refers to being in a state of being filled in the bore hole 1*a* formed in the concrete and restrained by the concrete of the frame 1 from a peripheral area when the frame 1 is an existing construction. In view of this, the integrity with the concrete is not impaired by a bearing pressure received by the filler 9 from the inserted portion 83, and a transmission effect of the bearing pressure received by the filler 9 from the inserted portion 83 to the concrete is less likely to be reduced.

A direction of the lock (the engagement) of the inserted portion 83 to the concrete or the filler 9 corresponds to a shear force transmission direction from the inserted portion 83 to the concrete, and further, the direction is a direction perpendicular to a boundary surface between the filler 9 and the concrete around it. Therefore, an occurrence of a case where the boundary surface between the filler 9 and the concrete is peeled off when the shear force is transmitted from the inserted portion 83 is avoided. Note that, when the frame 1 is a new construction, the shaft portion 81 (the anchor 8) is directly buried in the concrete, and the forming of the bore hole 1*a* and the filling of the filler 9 are not necessary. Therefore, there is no problem of the separation (peeling) between the filler 9 and the concrete.

When the head portion 82 having the inserted portion 83 is screwed with and connected to the shaft portion 81 as illustrated in FIG. 2A, the head portion 82 having the inserted portion 83 applies axial tensile force indicated by the arrow to the shaft portion 81 in association with the screwing into the shaft portion 81 to increase a contact pressure of a surface of the head portion 82 on the frame 1 side onto a surface of the frame 1. In view of this, the head portion 82 increases friction force between the surfaces of the head portion 82 and the frame 1 to serve to enhance the transmission effect of the shear force through the head portion 82. The head portion 82 in this case pairs up with a fixing portion 84 formed at an end portion of the shaft portion 81 on a hole bottom side of the bore hole 1*a* when the axial tensile force is applied to the shaft portion 81, and thus, the head portion 82 restrains the filler 9 in the bore hole 1*a* in the axial direction and applies axial compressive force to the filler 9, thereby serving to enhance the shearing strength of the filler 9.

When the inserted portion 83 is formed on the head portion 82 of the anchor 8 (claim 4), in the case where the inner circumferential surface of the inserted portion 83 is not circumscribed on the shaft portion 81 as a main body of the anchor 8 as illustrated in FIGS. 2A and 2B, fitting holes 1*b* with which the outer circumferential surface of the inserted portion 83 can be in contact and which have a plane area larger than that of the bore hole 1*a* are continuously formed in the bore hole 1*a* close to the inner circumferential surface of the frame 1 (claim 5). Thus, a constant bonding strength with the filler 9 is ensured over the whole length of a buried section of the shaft portion 81 inserted into the bore hole 1*a* including the fitting hole 1*b* into the filler 9. The term "the direction in which the outer circumferential surface of the inserted portion 83 comes in contact" is a direction perpendicular to the axial direction of the anchor 8.

The term "can be in contact" has a meaning including a case in which the whole outer circumferential surface of the inserted portion 83 is in a state of being substantially in contact with (in close contact with) an inner circumferential surface of the fitting hole 1*b* as illustrated in FIG. 2(*c*) and a case in which the whole outer circumferential surface of the inserted portion 83 is not in the state of being in contact as illustrated in FIG. 2B, and refers to including a case in which there is a slight void between the outer circumferential surface of the inserted portion 83 and the inner circumferential surface of the fitting hole 1*b*. The term "close to the inner circumferential surface of the frame 1" indicates a surface of the frame 1 on a side of the flanges 51, 61, and 71.

The term "the fitting holes 1*b* which have a plane area larger than that of the bore hole 1*a*" refers to a plane area A2 perpendicular to the axial direction of the inner circumferential surface of the fitting hole 1*b* being larger than a plane area A1 perpendicular to the axial direction of the inner circumferential surface of the bore hole 1*a* (A2>A1). The plane area A2 of the inner circumferential surface of the fitting hole 1*b* being larger than the plane area A1 of the inner circumferential surface of the bore hole 1*a* (A2>A1) also means that an inner diameter of the fitting hole 1*b* is larger than an inner diameter of the bore hole 1*a* when both the inner circumferential surface of the fitting hole 1*b* and the inner circumferential surface of the bore hole 1*a* have a circular shape.

Consider a case where the inner circumferential surface of the inserted portion is not circumscribed on the anchor main body (the shaft portion) as, for example, in Japanese Patent No. 5331268 and Japanese Patent No. 5978363 when the anchor is inserted into the bore hole in the concrete and is fixed by filling the filler in the bore hole. When the plane area of the bore hole is uniform in the axial direction as in these, the volume of the filler filled around a section close to the inserted portion of a buried section of the anchor into the concrete is reduced by the volume of the inserted portion when the inserted portion fits in the bore hole. In the present invention, the amount per unit length of the shaft portion 81 of the filler 9 around the shaft portion 81 in a section of the fitting hole 1*b* becomes smaller than the amount of the filler 9 around the shaft portion 81 in a section of the bore hole 1*a* excluding the fitting hole 1*b*. As the result, the bonding strength with the filler in the section is lowered to possibly lower the stability in a pull-out.

It is possible that a section close to the head portion 82 as a part with a small bonding strength is peeled off of the filler 9 unless the bonding strength with the filler 9 in the buried section of the shaft portion 81 of the anchor 8 into the concrete is constant (uniform) in the axial direction. When the peeling occurs in the section close to the head portion 82 of the shaft portion 81, there is generated a situation where the tensile force is resisted by a bonding strength of another part only, and a part continuing to the peeled section also becomes easily peeled. Therefore, it is difficult to ensure a situation where the whole length of the buried section of the shaft portion 81 continues to uniformly resist the tensile force.

In contrast to this, the plane area A2 of the fitting hole 1*b* being larger than the plane area A1 of the bore hole 1*a* as illustrated in FIGS. 2B and 2C (A2>A1) ensure obtaining a state where the amount of the filler 9 around the shaft portion 81 in the section of the fitting hole 1*b* is not extremely less than the amount of the filler 9 around the shaft portion 81 in the section of the bore hole 1*a* excluding the fitting hole 1*b*. That is, regardless of the insertion of the inserted portion 83 into the fitting hole 1*b*, it is possible to obtain a situation where the filler 9 of an approximately equal amount per unit length surrounds the shaft portion 81 over the whole length of the buried section of the shaft portion 81 into the concrete. As the result, a bonding strength of a certain degree or more can be obtained over the whole length of the shaft portion 81 inserted into the bore hole 1*a* including the fitting hole 1*b*, thereby improving the stability in the pull-out of the shaft portion 81.

In particular, in the case where a plane area A3 perpendicular to the axial direction of the inner circumferential surface of the inserted portion 83 when the inserted portion 83 is inserted into the fitting hole 1*b* is equal to or more than the plane area A1 perpendicular to the axial direction of the inner circumferential surface of the bore hole 1*a* as illustrated in FIGS. 2C and 2D (A3≥A1) (claim 6), regardless of the insertion of the inserted portion 83 into the fitting hole 1*b*, it is possible to obtain a situation where the filler 9 of the same amount or more per unit length surrounds the shaft portion 81 over the whole length of the buried section of the shaft portion 81 into the concrete, thereby further improving the stability in the pull-out. The plane area A3 of the inner circumferential surface of the inserted portion 83 being equal to or more than the plane area A1 of the inner circumferential surface of the bore hole 1*a* can also be said that an inner diameter of the inserted portion 83 is equal to or more than the inner diameter of the bore hole 1*a* when the inner circumferential surface of the inserted portion 83 and the inner circumferential surface of the bore hole 1*a* have a circular shape. In FIG. 2C, a backing metal 11 in FIGS. 2A and 2B is omitted.

Since the plane area A3 perpendicular to the axial direction of the inner circumferential surface of the inserted portion 83 when the inserted portion 83 is inserted into the fitting hole 1*b* has a size equal to or more than the plane area A1 perpendicular to the axial direction of the bore hole 1*a* (A3≥A1), the plane area A2 perpendicular to the axial direction of the inner circumferential surface of the fitting hole 1*b* is larger than the plane area A1 perpendicular to the axial direction of the bore hole 1*a* (A2>A1).

As the result, the constant (uniform) bonding strength is ensured on the whole length of the buried section of the shaft portion 81 of the anchor 8 into the concrete (the filler 9), and therefore, there is an advantage that the bonding strength on the whole length of the buried section can resist the tensile force. When the cross-sectional shapes of the fitting hole 1*b* and the bore hole 1*a* are both circular shapes as illustrated in in FIGS. 2C and 2D, it is only necessary that the inner diameter of the fitting hole 1*b* has a size such that an inner diameter of the fitting portion 52 when the fitting portion 52 is inscribed in the fitting hole 1*b* is equal to or larger than the inner diameter of the bore hole 1*a*.

When the inner circumferential surface of the inserted portion 83 is circumscribed on the shaft portion 81, the filler 9 is filled around a section exposed from the inserted portion 83 of the shaft portion 81, and therefore, the bonding strength with the filler 9 in a part of the section of the shaft portion 81 exposed from the inserted portion 83 is not lower than the bonding strength of another section.

Effects of the Invention

The reinforcing frame made of steel, which has the elevational shape surrounding the frame along the inner circumferential surface of the frame and the cross-sectional shape with the flange on the frame side, is disposed in the structure plane of the column and beam frame, the reinforcing frame has the column portion along the column, the beam portion along the beam, and the connecting portion connecting the column portion to the beam portion, and the part of the flange of the connecting portion is in the state of floating from the corner of the frame. Thus, it is possible not to provide the forcible deformation to the flange from the frame when the frame deforms in the structure plane direction.

Accordingly, the following capability of the part of the flange to the interlayer deformation angle is improved to reduce the forcible deformation to which the flange is subjected, and therefore, it is possible to reduce the forcible deformation to which the web is subjected from the flange as well. As the result, the fatigue caused by the forcible deformation of the flange and the web, and the fracture caused by the fatigue are easily avoided.

DESCRIPTION OF PREFERRED EMBODIMENTS

Figure 1:
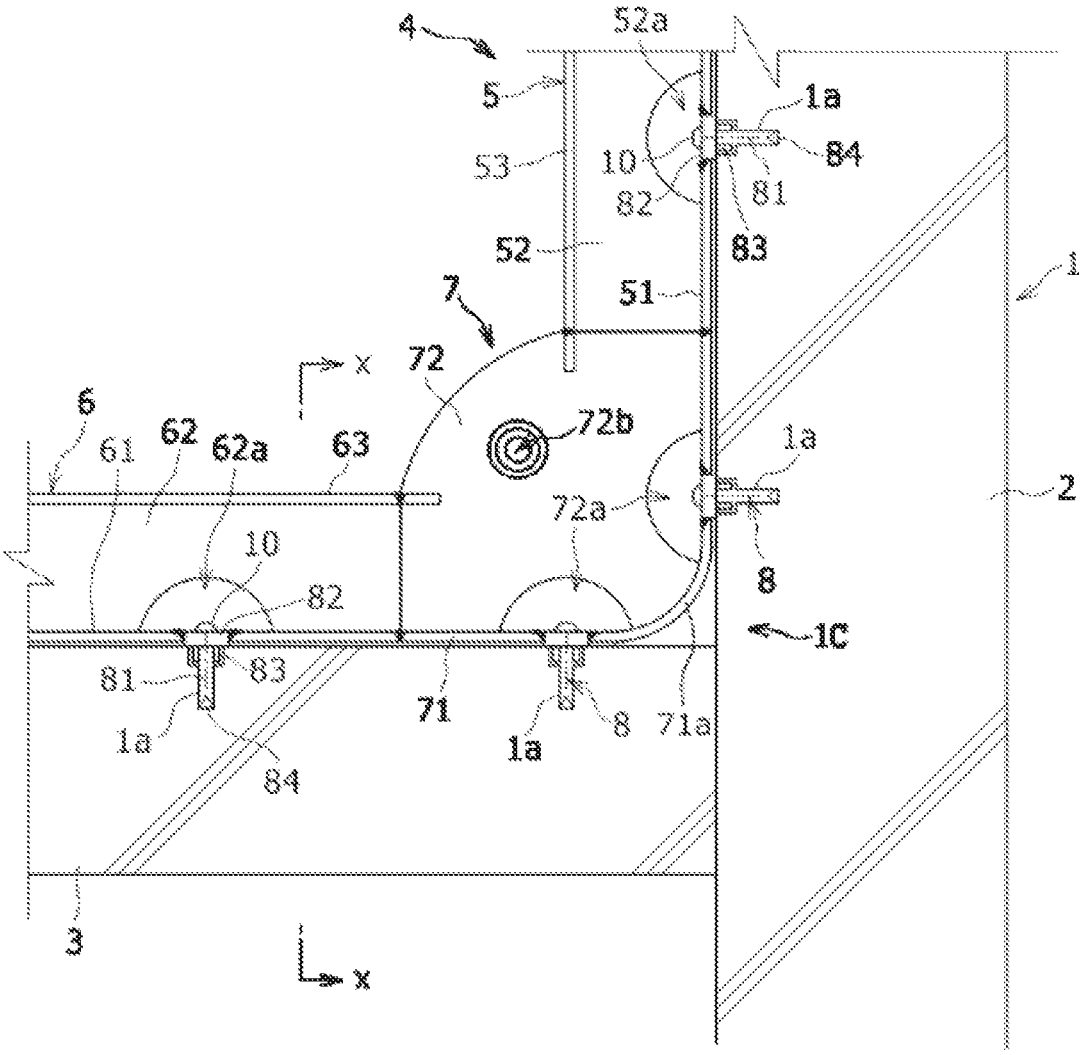
FIG. 1 is an elevational view illustrating a state where a reinforcing frame is joined while being in contact with an inner circumferential surface of a frame of a column and a beam.

FIG. 1 illustrates a specific example of a reinforced structure for a column and beam frame in which a reinforcing frame 4 made of steel is disposed in a structure plane of a frame 1 formed of a column 2 and a beam 3 of reinforced concrete structure, and is joined to an inner circumferential surface of the frame 1. The reinforcing frame 4 has an elevational shape that surrounds the frame 1 along an inner circumferential surface of the frame and a cross-sectional shape with a flange on a side of the frame 1. The reinforcing frame 4 is formed of a column portion 5 disposed along an inner circumferential surface of the column 2, a beam portion 6 disposed along an inner circumferential surface of the beam 3, and a connecting portion 7 joined to both an end surface in an axial direction of the column portion 5 and an end surface in an axial direction of the beam portion 6 by welding, bolt, or the like to connect the column portion 5 to the beam portion 6. The terms "the inner circumferential surface of the column 2" and "the inner circumferential surface of the beam 3" indicate surfaces of the column 2 and the beam 3, respectively, on sides of openings surrounded by the frame 1 (the inner circumferential surface of the frame 1).

The term "disposed along the inner circumferential surface of the frame 1" refers to a flange 51 of the column portion 5 and a part of a flange 71 of the connecting portion 7 overlapping the inner circumferential surface of the column 2, and a flange 61 of the beam portion 6 and the part of the flange 71 of the connecting portion 7 overlapping the inner circumferential surface of the beam 3, which are disposed to be in contact with each other directly or indirectly on the surfaces. The term "the part of the flange 71" indicates a corner 71*a* of the flange 71 that ensures a void between the corner 71*a* and a corner 1C of the frame 1.

Figure 2A:
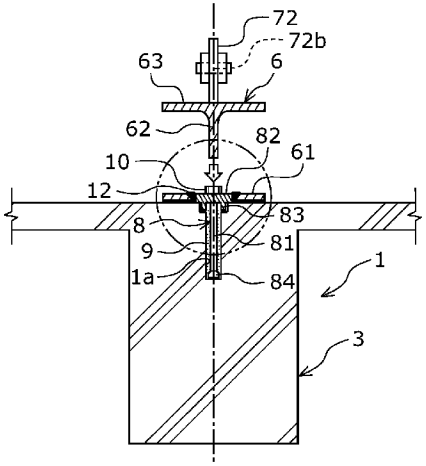
FIG. 2A is a cross-sectional view taken along the line x-x in FIG. 1.
Figure 2B:
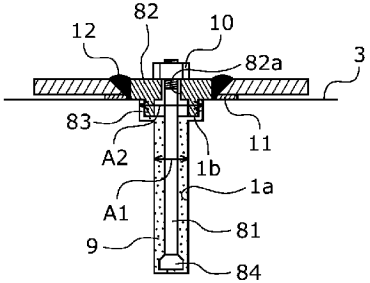
FIG. 2B is a partially enlarged view of FIG. 2A.

The word "directly" refers to the surfaces of the flanges 51, 61, and 71 on the frame 1 sides being directly in contact with the frame 1 or a slight void separating the surfaces on the frame 1 sides and the inner circumferential surface of the frame 1 as illustrated in FIGS. 2A and 2B. The word "indirectly" refers to any thin-walled buffer being interposed between the flanges 51, 61, and 71 and the frame 1. Alternatively, it refers to a filler 9, such as mortar, leaked from an inside of a bore hole 1*a* while being filled into the bore hole 1*a* formed in concrete of the frame 1, and gotten into the back of the flanges 51, 61, and 71 of the reinforcing frame 4 being interpose.

FIGS. 2A and 2B illustrate an example in the case where a backing metal 11 is disposed on back surface sides (the frame 1 sides) of the flanges 51, 61, and 71 when the flanges 51, 61, and 71 are welded to head portions 82 of anchors 8, described below, for joining (securing) the flanges 51, 61, and 71 to the frame 1. While in this example, voids of a wall thickness of the backing metal 11 are formed between the back surfaces of the flanges 51, 61, and 71 and the frame 1 in the case where the back surfaces of the flanges 51, 61, and 71 are flat surfaces, the voids are not formed in the case where grooves in which the backing metals 11 fit are formed on the back surfaces of the flanges 51, 61, and 71. In FIGS. 2A and 2B, the reference numeral 12 denotes a weld metal.

The reinforcing frame 4 is joined (secured) to the frame 1 by burying and fixing shaft portions 81 of the anchors 8, such as anchor bolts and post-installed anchors, which pass through at least the flange 51 of the column portion 5 and the flange 61 of the beam portion 6, in the concrete of the frame 1. While in the drawing, the reinforcing frame 4 is joined to the frame 1 even in the flange 71 of the connecting portion 7 for the purpose of ensuring integrity with the frame 1 in the connecting portion 7, the flange 71 of the connecting portion 7 is not necessarily joined to the frame 1.

The column portion 5 and the beam portion 6, and the connecting portion 7 that constitute the reinforcing frame 4 each overlap the inner circumferential surface of the frame 1, and have the flanges 51, 61, and 71 joined (fixed) to the frame 1 and webs 52, 62, and 72 that form surfaces perpendicular to the flanges 51, 61, and 71 to bear shear force when an in-plane deformation occurs in the frame 1. When respective configuration portions (the column portion 5 and beam portion 6, and the connecting portion 7) of the reinforcing frame 4 are formed of the flanges 51, 61, and 71 and the webs 52, 62, and 72, the reinforcing frame 4 is formed into a T-shaped cross-sectional shape on a cross-sectional surface perpendicular to the column portion 5 and the beam portion 6.

As illustrated in FIG. 1, when flanges 53 and 63 that pair up with the flanges 51 and 61 are integrated with the webs 52 and 62 of the column portion 5 and the beam portion 6, the reinforcing frame 4 is formed into an H-shaped cross-sectional shape. When the frame 1 deforms, the flanges 51 and 61 of the column portion 5 and the beam portion 6 serve as resistance elements against a bending moment, and thus, it is rational that the flanges 53 and 63 that pair up with the flanges 51 and 61 are formed.

The connecting portion 7 that is provided between the column portion 5 and the beam portion 6 basically plays a role of continuing the column portion 5 and the beam portion 6 in a circumferential direction of the reinforcing frame 4, and does not play a role of reinforcing the frame 1 as much as the column portion 5 and the beam portion 6 do. The connecting portion 7 is only necessary to provide a function of mainly maintaining the state where the column portion 5 and the beam portion 6 are joined to the frame 1 while flexibly following a generated interlayer deformation angle of the corner 1C of the frame 1 when the in-plane deformation occurs in the frame 1. In relation to this, the web 72 of the connecting portion 7 does not have a flange that pairs up with the flange 71 in FIG. 1. The flange that pairs up with the flange 71 may be formed.

In the illustrated example, not forming the flange that pairs up with the flange 71 relatively lowers flexural rigidity in an in-plane direction of the web 72 with respect to the column portion 5 and the beam portion 6 in the entire connecting portion 7, and therefore, an elastic deformation or a plastic deformation easily occurs when the frame 1 deforms, and the connecting portion 7 easily follows the deformation of the frame 1. In FIG. 1, a hole formed in the web 72 is an insertion hole 72*b* for connecting an end portion of a brace installed in the reinforcing frame 4 as described later by using a metal fitting, such as a clevis.

The flange 71 of the connecting portion 7 has parts close to the column portion 5 and the beam portion 6 shaped along the inner circumferential surface of the frame 1 and a part of the flange 71 facing the corner 1C of the frame 1 (the corner 71*a*) having a shape in which a void is formed between the corner 71*a* and the corner 1C of the frame 1. The term "shaped along the inner circumferential surface of the frame 1" refers to a part of the flange 71 close to the column portion 5 being disposed along the inner circumferential surface of the column 2 and a part of the flange 71 close to the beam portion 6 being disposed along the inner circumferential surface of the beam 3. The term "the corner 1C of the frame 1" indicates a corner where the column 2 intersects with the beam 3, and has a length corresponding to the corner 71*a* of the flange 71 of the connecting portion 7 in the axial directions of the column 2 and the beam 3.

The term "(the corner 71*a* having) a shape in which a void is formed between the corner 71*a* and the corner 1C of the frame 1" refers to a shape that maintains a state where the corner 71*a* of the flange 71 facing the corner 1C of the frame 1 is in contact with neither the inner circumferential surface of the column 2 nor the inner circumferential surface of the beam 3 during a normal period when the frame 1 is not deformed. While the term "the shape that maintains the state of not contacting the inner circumferential surfaces of the column 2 or the beam 3" is not particularly defined, it specifically refers to a shape in which the corner 71*a* of the flange 71 of the connecting portion 7 is curved as illustrated in FIG. 1.

The corner 71*a* of the flange 71 illustrated in FIG. 1 may be formed into a multangular shape or a shape that forms a part of a multangular shape. When the corner 71*a* of the flange 71 is curved as illustrated, the flexural rigidity in the curved section is uniform, and therefore, it is less likely that any part of the flange 71 is intensively deformed when the flange 71 follows the in-plane deformation of the frame 1. As the result, the concentration of stress to the flange 71 is easily avoided, thereby providing an advantage that the fracture is less likely to occur in the flange 71.

The anchor 8 is disposed at one position on a center in a width direction or a plurality of positions spaced in the width direction of each of the flanges 51, 61, and 71 of the reinforcing frame 4 as illustrated in FIG. 1 and FIGS. 2A-2D. The latter case also includes a staggered arrangement. The anchor 8 passes through an insertion hole formed in each of the flanges 51, 61, and 71 of the reinforcing frame 4.

When the frame 1 deforms, a relative movement (slippage) can occur in the axial directions of the column 2 and the beam 3 between the frame 1 and the flanges 51, 61, and 71 of the reinforcing frame 4. In view of this, the anchor 8 is divided into the shaft portion 81 inserted into the above-described bore hole 1*a* and the head portion 82 connected to the shaft portion 81 for the purpose of avoiding the fracture in the part of the anchor 8 projecting toward a side of the reinforcing frame 4 from the inner circumferential surface of the frame 1 caused by this relative movement. Then, an inserted portion 83 inserted into the bore hole 1*a* and in a shape continuing in a circumferential direction of the head portion 82 is formed in the head portion 82 on the side of the frame 1.

The head portions 82 are connected to the shaft portions 81 on sides of the reinforcing frame 4 by screwing or the like, and are exposed to the flanges 51, 61, and 71 on the inner circumferential surface side of the frame 1. The head portions 82 have surfaces on sides of an inner circumference of the frame 1 aligned with the surfaces of the flanges 51, 61, and 71 on the inner circumference sides of the frame 1, such as obtaining flush surfaces with the surfaces of the flanges 51, 61, and 71 on the inner circumference sides of the frame 1. When viewed without the flanges 51, 61, or 71, the head portions 82 project toward the inner circumference sides from the inner circumferential surface of the frame 1.

In the respective webs 52, 62, and 72 of the reinforcing frame 4, openings 52*a*, 62*a*, and 72*a* are formed for an operation of inserting the shaft portions 81 of the anchors 8 into the bore holes 1*a* and filling the filler 9, such as mortar and an adhesive, filled into voids in the bore holes 1*a* after the insertion of the shaft portions 81. The openings 52*a*, 62*a*, and 72*a* also serve to lower flexural rigidity of the webs 52, 62, and 72 and to make the webs 52, 62, and 72 themselves easily bent and deformed in the in-plane directions.

The shaft portion 81 has a distal end portion (a hole bottom side of the bore hole 1*a*) at which a fixing portion 84 buried into the filler 9 and fixed within the bore hole 1*a* is integrally formed or is connected to be integrated. As illustrated in FIG. 2A, when the shaft portion 81 of the anchor 8 is inserted into the bore hole 1*a* and the bottom surface of the fixing portion 84 comes into contact with or approaches close to the hole bottom of the bore hole 1*a*, the inserted portion 83 of the head portion 82 has an outer circumferential surface in a state of possibly being inscribed in a part close to the reinforcing frame 4 of the bore hole 1*a*.

Figure 3:
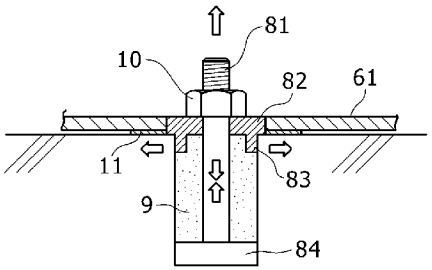
FIG. 3 is a vertical cross-sectional view illustrating a detailed example of an anchor.

The shaft portion 81 has a part (a section) close to the reinforcing frame 4 projecting toward sides of the webs 52, 62, and 72 of the reinforcing frame 4 from the head portion 82 as illustrated in FIG. 3. By filling the filler 9 into the bore hole 1*a*, the inserted portion 83 is buried in the filler 9 inside the bore hole 1*a*. Since the inserted portion 83 is inscribed in the bore hole 1*a*, the inserted portion 83 is in a lockable state in a radiation direction to an inner circumferential surface of the bore hole 1*a*.

The part projecting from the head portion 82 of the shaft portion 81 is screwed with a nut 10 for applying axial tensile force to the shaft portion 81. The nut 10, by being screwed with the shaft portion 81, applies the axial tensile force indicated by the arrow in FIG. 3 to the shaft portion 81, in order to increase a contact pressure of the head portion 82 onto the inner circumferential surface of the frame 1, the nut 10 serves to increase friction force between the head portion 82 and the inner circumferential surface of the frame 1 and to enhance a transmission effect of shear force via the head portion 82. The head portion 82 pairs up with the fixing portion 84 when the axial tensile force is applied to the shaft portion 81, and thus, the head portion 82 restrains the filler 9 in the bore hole 1*a* in the axial direction and applies axial compressive force to the filler 9. Therefore, the head portion 82 also serves to enhance a shearing strength of the cured filler 9.

When the anchor 8 passes through the insertion hole formed in each of the flanges 51, 61, and 71 of the reinforcing frame 4, the head portion 82 is in the lockable state to an inner circumferential surface of the insertion hole directly in the in-plane directions of the flanges 51, 61, and 71 or via the filler 9 overflown from the inside of the bore hole 1*a*. On the other hand, since the inserted portion 83 is in a locked state to the inner circumferential surface of the bore hole 1*a*, the transmission of the shear force in any direction perpendicular to an axis of the shaft portion 81 is possible between the frame 1 and the flanges 51, 61, and 71, and the head portion 82 of the anchor 8 as indicated by the arrow in FIG. 3. Accordingly, there is provided the state where the head portion 82 can transmit the force in the in-plane direction received from the flanges 51, 61, and 71 to the concrete of the frame 1 through the inserted portion 83.

FIGS. 2A and 2B illustrate an example in the case where the bore hole 1*a* into which the shaft portion 81 enters from sides of the flanges 51, 61, and 71 is formed in the frame 1 (the column 2 and the beam 3) when the inserted portion 83 is continuously formed in the head portion 82, and a fitting hole 1*b* that can be in contact with the outer circumferential surface of the inserted portion 83 is formed in the bore hole 1*a* on the sides of the flanges 51, 61, and 71.

In this case, for the purpose of ensuring a constant stability of the shaft portion 81 in being pulled out from the filler 9 in the section of the inserted portion 83, a plane area A2 larger than a plane area A1 of the inner circumferential surface perpendicular to the axial direction, such as an inner diameter of the bore hole 1*a*, is provided to the inner circumferential surface perpendicular to the axial direction, such as an inner diameter of the fitting hole 1*b* in FIGS. 2A and 2B. Since the plane area A2 of the fitting hole 1*b* is larger than the plane area A1 of the bore hole 1*a* (A2>A1), a situation where the filler 9 of an approximately equal amount per unit length surrounds the shaft portion 81 over the whole length of the buried section of the shaft portion 81 into the concrete (the filler 9) is obtained regardless of the insertion of the inserted portion 83 into the fitting hole 1*b*, thereby ensuring the stability in the pull-out of a certain degree or more of the shaft portion 81.

Figure 2C:
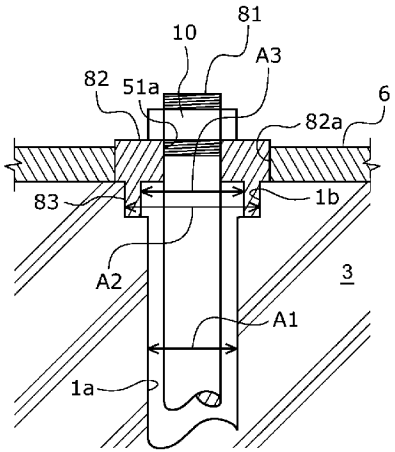
FIG. 2C is a vertical cross-sectional view illustrating a relationship between a cross-sectional area of a shaft portion and a plane area of a bore hole, and a plane area of a fitting hole when a plane area of an inserted portion is equal to or more than the plane area of the bore hole (A3≥A1).

FIG. 2C particularly illustrates an example where a plane area A3 having a size equal to or larger than the plane area A1 of the inner circumferential surface perpendicular to the axial direction, such as the inner diameter of the bore hole 1*a*, is provided to the inner circumferential surface perpendicular to the axial direction, such as an inner diameter of the inserted portion 83. In this case, since the plane area A3 perpendicular to the axial direction of the inner circumferential surface of the inserted portion 83 has the size equal to or larger than the plane area A1 perpendicular to the axial direction of the inner circumferential surface of the bore hole 1*a* (A3≥A1), a situation where the filler 9 of the same amount or more per unit length surrounds the shaft portion 81 over the whole length of the buried section of the shaft portion 81 into the concrete can be obtained compared with the case of A3<A1, thereby further improving the stability in the pull-out.

Figure 2D:
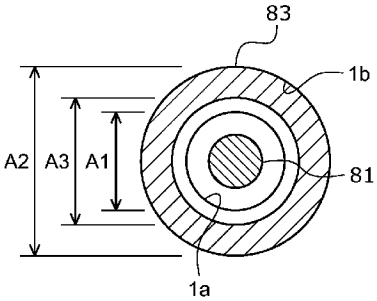
FIG. 2D is a horizontal cross-sectional view at the inserted portion in FIG. 2C.

In the case of FIG. 2C, since the plane area A3 of the inner circumferential surface of the fitting portion 52 has the size equal to or larger than the plane area A1 of the inner circumferential surface of the bore hole 1*a* (A3≥A1), a projected area in a direction of an action of shear force of the fitting portion 52 is enlarged more than the case of A3<A1, thereby enhancing the shear force transmission effect by the amount. In this case, the plane area A2 perpendicular to the axial direction of the inner circumferential surface of the fitting hole 1*b* is larger than the plane area A1 perpendicular to the axial direction of the inner circumferential surface of the bore hole 1*a* by the wall thickness of the inserted portion 83 (A2>A1). FIG. 2D illustrates a relationship of the plane area A1 of the inner circumferential surface of the bore hole 1*a*, the plane area A3 of the inner circumferential surface of the fitting portion 52, and the plane area A2 of the inner circumferential surface of the fitting hole 1*b* in the case of FIG. 2C. Here, A1 represents the inner diameter of the bore hole 1*a*, A3 represents the inner diameter of the inserted portion 83, and A2 represents the inner diameter of the fitting hole 1*b* for convenience.

When there is no fitting hole 1*b* having the plane area A2 larger than the plane area A1 of the inner circumferential surface of the bore hole 1*a* and the plane area A1 of the bore hole 1*a* is constant in the axial direction, the volume of the filler 9 filled around the section close to the inserted portion 83 in the buried section of the shaft portion 81 into the frame 1 (the concrete) is decreased by the volume of the inserted portion 83 when the inserted portion 83 fits in the bore hole 1*a*, thereby possibly lowering the bonding strength with the filler 9 in the section. It is possible to have a situation where a part with a small bonding strength is peeled off from the filler 9 and the bonding strength of another part only resists the tensile force, unless the bonding strength with the filler 9 in the buried section into the frame 1 is constant (uniform).

In contrast to this, forming the fitting hole 1*b* having the plane area A2 close to the flanges 51, 61, and 71 of the bore hole 1*a* such that the plane area A3 perpendicular to the axial direction of the inner circumferential surface of the inserted portion 83 is equal to or larger than the plane area A1 perpendicular to the axial direction of the inner circumferential surface of the bore hole 1*a*, it is possible to have a situation where the filler 9 of the same amount surrounds the shaft portion 81 over the whole length of the buried section of the shaft portion 81 into the frame 1 regardless of the insertion of the inserted portion 83 into the fitting hole 1*b*. In view of this, a constant bonding strength is ensured over the whole length of the buried section into the frame 1, thereby providing an advantage that the bonding strength of the whole length of the buried section can resist the tensile force.

Figure 4:
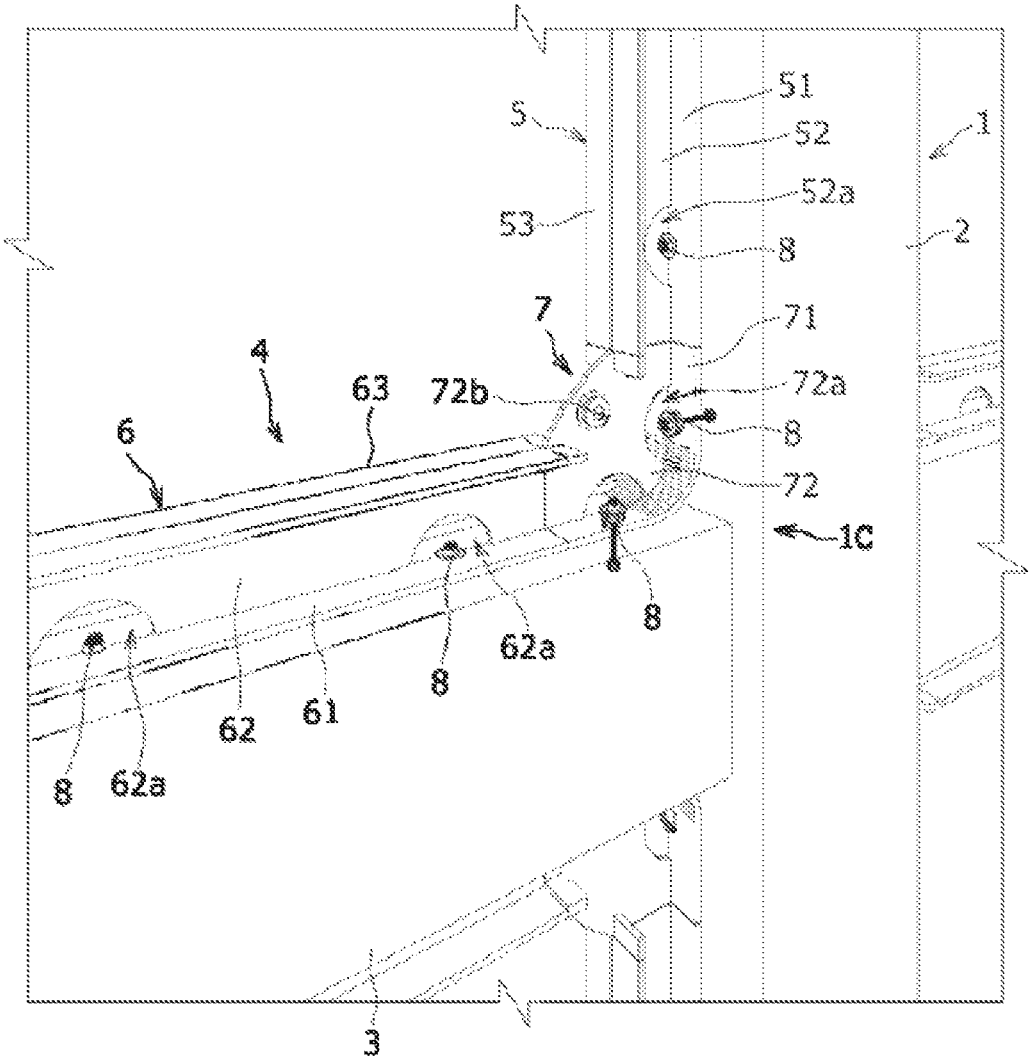
FIG. 4 is a perspective view of FIG. 1.
Figure 5:
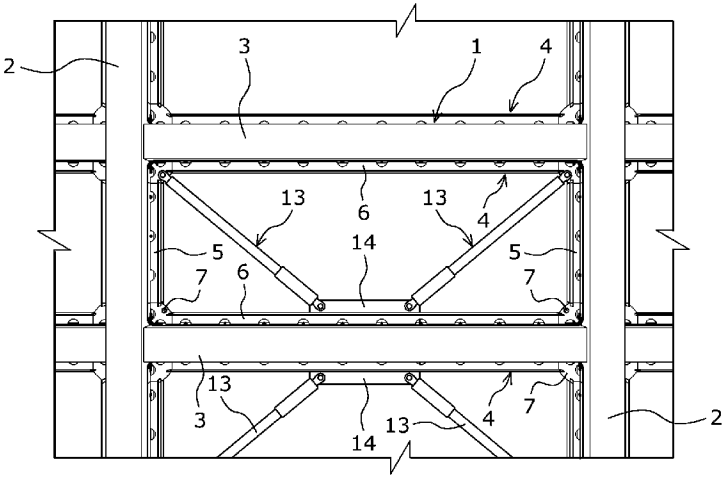
FIG. 5 is an elevational view illustrating a state where the reinforcing frame is disposed in one layer of the frame.
Figure 6:
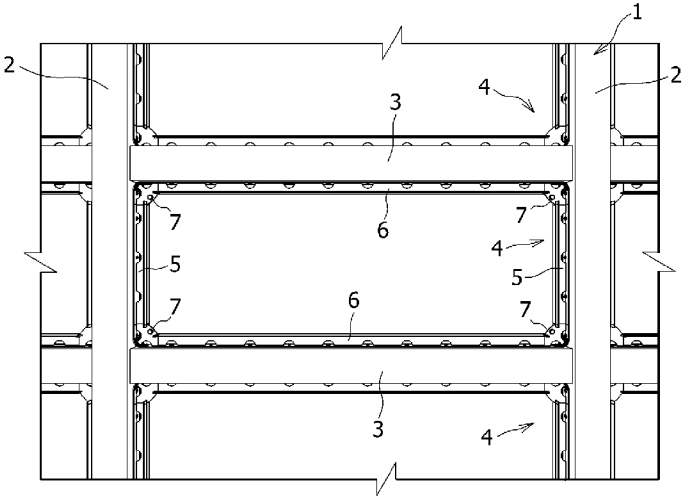
FIG. 6 is an elevational view illustrating a state where braces are installed in the reinforcing frame illustrated in FIG. 5.

FIG. 5 illustrates all the frame 1 and the reinforcing frame 4 including column and beam joint portions in the frame 1 illustrated in FIG. 1 and FIG. 4. FIG. 6 illustrates a state where braces (damper integral-typed braces) 13 are installed between the connecting portion 7 on an upper side and the beam portion 6 on a lower side in the reinforcing frame 4 illustrated in FIG. 5. The brace 13 has an end portion at one side in an axial direction, for example, pin-joined to the insertion hole 72*b* of the connecting portion 7 and has an end portion at the other side, for example, pin-joined to the insertion hole formed in a gusset plate 14 joined to the flange 63 of the beam portion 6.

DESCRIPTION OF REFERENCE SIGNS

1 . . . frame
2 . . . column
3 . . . beam
1*a* . . . bore hole
1*b* . . . fitting hole
1C . . . corner
4 . . . reinforcing frame
5 . . . column portion
51 . . . flange
52 . . . web
52*a* . . . opening
53 . . . flange
6 . . . beam portion
61 . . . flange
62 . . . web
62*a* . . . opening
63 . . . flange
7 . . . connecting portion
71 . . . flange
71*a* . . . corner
72 . . . web
72*a* . . . opening

72*b* . . . insertion hole
8 . . . anchor
81 . . . shaft portion
82 . . . head portion
83 . . . inserted portion
84 . . . fixing portion
9 . . . filler
10 . . . nut
11 . . . backing metal
12 . . . weld metal
13 . . . brace
14 . . . gusset plate

The invention claimed is:

1. A reinforced structure for a column and beam frame comprising:

a reinforcing frame made of steel disposed in a structure plane of a frame of, a column and a beam of reinforced concrete structure, the reinforcing frame being joined to an inner circumferential surface of the frame, the reinforcing frame having an elevational shape surrounding the frame along the inner circumferential surface of the frame, the reinforcing frame having a cross-sectional shape with a flange on a side of the frame; and a web forming a surface perpendicular to the flange, the flange directly or indirectly overlapping the inner circumferential surface of the frame, wherein the reinforcing frame includes:

a column portion along the column;

a beam portion along the beam; and a connecting portion joined to the column portion and the beam portion, the connecting portion connecting the column portion to the beam portion, and the connecting portion has a first flange part, from among parts of the flange, close to the column portion and a second flange part, from among the parts of the flange, close to the beam portion, shaped along the inner circumferential surface of the frame, the first flange part disposed along the inner circumferential surface corresponding to the column, the second flange part disposed along the inner circumferential surface corresponding to the beam, the first flange part, the second flange part, and a web part, from among parts of the web, corresponding to the connecting portion, are continuous in a circumferential direction of the reinforcing frame to a third flange part, from among the parts of the flange, corresponding to the column portion and a web part, from among the parts of the web, corresponding to the column portion, and to a fourth flange part, from among parts of the flange, corresponding to the beam portion and a web part, from among the parts of the web, corresponding to the beam portion, and the first and second flange parts of the connecting portion form a corner part of the flange facing a corner of the frame, to form a void between the corner part and the corner of the frame.

2. The reinforced structure for the column and beam frame according to claim 1, wherein the part of the flange of the connecting portion facing the corner of the frame is curved.

3. The reinforced structure for the column and beam frame according to claim 2, wherein to a flange part, from among the parts of the flange, an anchor that passes through the flange part and is buried in the frame is fixed, and the anchor has a shaft portion inserted into a bore hole formed in the frame and a head portion connected to the shaft portion, and has an inserted portion inserted into the bore hole and in a shape continuing in a circumferential direction of the head portion formed in the head portion on a side of the frame.

4. The reinforced structure for the column and beam frame according to claim 2, wherein the flange of the connecting portion is joined to the column and the beam of the frame.

5. The reinforced structure for the column and beam frame according to claim 1, wherein the flange of the connecting portion is joined to the column and the beam of the frame.

6. The reinforced structure for the column and beam frame according to claim 1, wherein to a flange part, from among the parts of the flange, an anchor that passes through the flange part and is buried in the frame is fixed, and the anchor has a shaft portion inserted into a bore hole formed in the frame and a head portion connected to the shaft portion, and has an inserted portion inserted into the bore hole and in a shape continuing in a circumferential direction of the head portion formed in the head portion on a side of the frame.

7. The reinforced structure for the column and beam frame according to claim 6, wherein the bore hole has a fitting hole continuously formed close to the inner circumferential surface of the frame, the fitting hole being contactable with an outer circumferential surface of the inserted portion, the fitting hole having an inner circumferential surface with a plane area perpendicular to an axial direction larger than a plane area perpendicular to an axial direction of an inner circumferential surface of the bore hole.

8. The reinforced structure for the column and beam frame according to claim 7, wherein the inserted portion has an inner circumferential surface with a plane area perpendicular to an axial direction when the inserted portion is inserted into the fitting hole is equal to or larger than the plane area perpendicular to the axial direction of the inner circumferential surface of the bore hole.

* * * * *